US005295626A

United States Patent [19]

Mirabito

[11] Patent Number: 5,295,626

[45] Date of Patent: Mar. 22, 1994

[54] SPRAY APPARATUS FOR AN AIRLESS SPRAY SYSTEM

[76] Inventor: Rick Mirabito, 2601 Alvord La., Redondo Beach, Calif. 90278

[21] Appl. No.: 57,360

[22] Filed: May 5, 1993

[51] Int. Cl.[5] ..... B05B 7/02; B05B 1/14

[52] U.S. Cl. ..... 239/526; 239/551; 239/562; 239/565; 239/568

[58] Field of Search ..... 239/525, 526, 550, 551, 239/565, 568, 562; 118/313, 315

[56] References Cited

U.S. PATENT DOCUMENTS

| | | | |
|---|---|---|---|
| 1,239,075 | 9/1917 | Bagnell et al. | 239/565 |
| 2,380,827 | 7/1945 | Downs | 239/526 |
| 2,683,626 | 7/1954 | Wahlin | 239/565 |
| 2,696,449 | 12/1954 | Ericks et al. | 118/313 |
| 3,561,398 | 2/1971 | Rose | 239/69 |
| 3,885,066 | 5/1975 | Schwenninger | 118/315 |
| 4,432,301 | 2/1984 | Diesel | 118/315 |
| 4,458,626 | 7/1984 | Dessilani | 118/315 |
| 4,465,714 | 8/1984 | Petro, IV | 118/313 |

OTHER PUBLICATIONS

"Wagner 650 Airless Spraying System", by Wagner Spray Tech Corp (undated).

"Airless Spray Gun Accessories", 206-236 Dual Spray Nozzle (undated).

*Primary Examiner*—Andres Kashnikow
*Assistant Examiner*—Christopher G. Trainor
*Attorney, Agent, or Firm*—Lee W. Tower

[57] ABSTRACT

A spray apparatus including an airless spray system, a spray gun having an on and off control, and a center spray device coupled to the spray gun for providing a spray, the improvement which includes: a center valve device coupled to the center spray device for turning the center spray device on and off; a first extension device coupled to the spray gun for providing an extension from the spray gun; first spray device for providing a spray attached to the first extension device; a first device for directing pressurized liquid from the spray gun to the first spray device coupled to the first spray device; and a first valve device for turning the first spray device on and off coupled to the first spray device. The improved airless spray system reduces the cost of spray painting with an airless spray system and increases productivity, while maintaining an even spray fan beam.

12 Claims, 3 Drawing Sheets

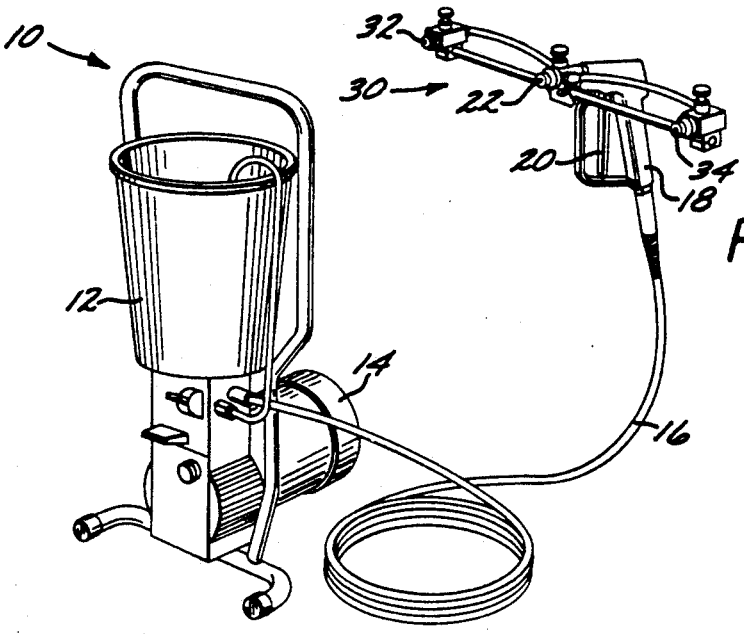
FIG. 1
FIG. 2
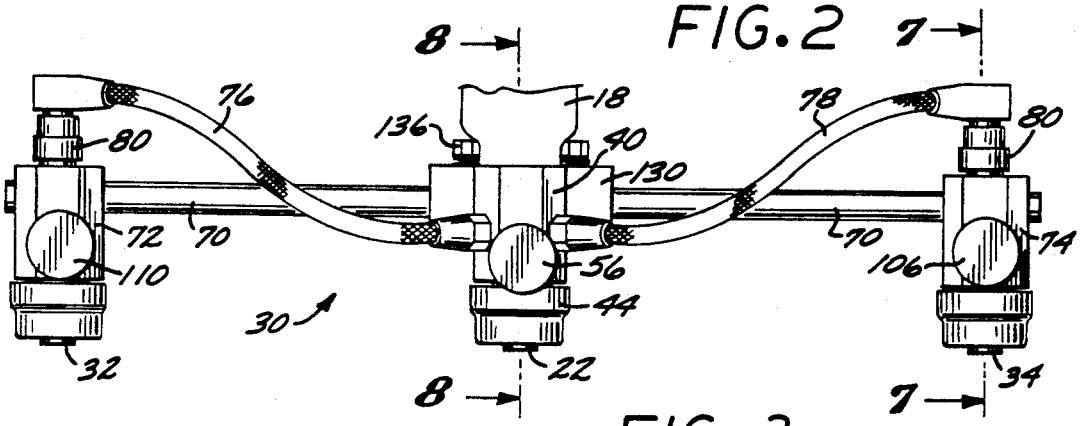
FIG. 3
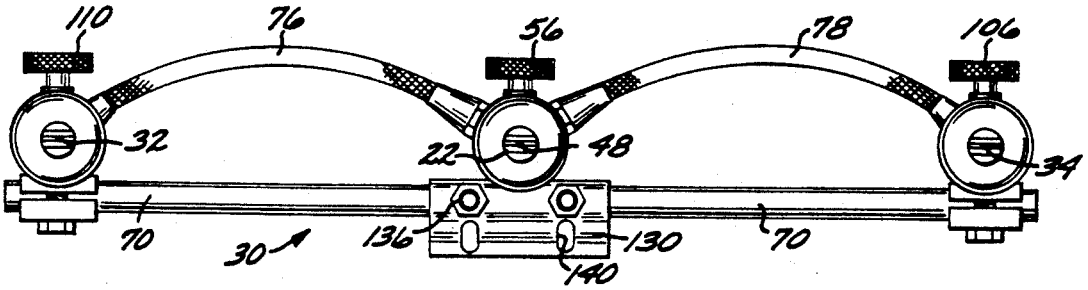
FIG. 4
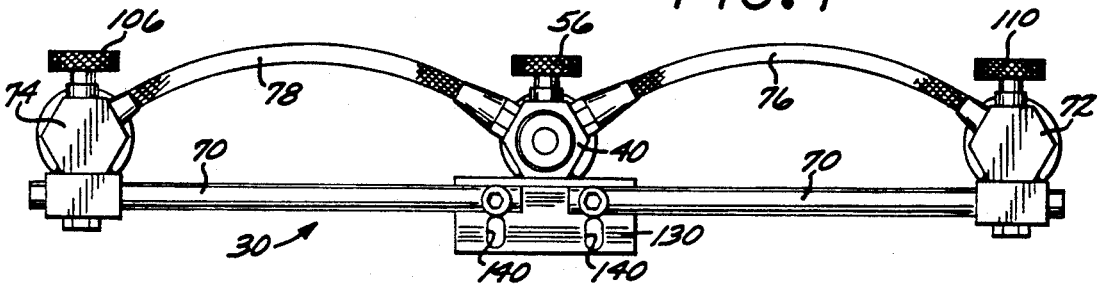

SPRAY APPARATUS FOR AN AIRLESS SPRAY SYSTEM

BACKGROUND OF THE INVENTION

1. Field of the Invention

This invention relates to spray systems and more particularly to airless spray systems.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

2. Description of the Related Art

Painting is a very labor intensive endeavor and costs are primarily a function of the painter labor cost. Thus, it is important to increase the productivity of painters as much as possible.

There are a number of ways to paint a surface, such as a wall, structure or house. One conventional approach is to use paint brushes; however this is prohibitively expensive for large structures, because the painter can only apply paint at a rate which is determined by the width of the brush and it is necessary to continuously dip the brush into paint to rewet the brush. One conventional approach that speeds paint application is to use a paint roller; however, this has also proven to be relatively costly for painting large structures and has the same shortcoming that the roller must be continually rewetted with paint.

A conventional approach that does not need continual pausing to rewet a brush or roller is to use an airless spray system, which can be used to spray paint and other fluids. An airless spray system consists of a pump that pressurizes paint drawn from a tank to about 2500 pounds per square inch. The pressurized paint is sent through a high pressure hose to a spray gun with a single spray tip nozzle, which has a trigger controlled by the painter. The painter points the spray gun at the surface to be painted, activates the spray gun trigger, and moves the spray gun in a sweeping motion covering the surface with paint. The speed at which the painter can move the fan of paint spray across the surface is a function of the amount of paint that must be applied and the width of the fan beam of paint spray from the single spray tip nozzle.

There is a numbering system for spray tips, which are nozzles placed on the spray gun, that indicates the width of the fan beam and the size of the opening in the nozzle. The width of the fan beam is the width of the paint spray fan beam on a surface one foot from the spray gun nozzle. The size of the opening in the nozzle indicates the paint flow rate from the spray tip. A larger size opening in a spray tip increases the paint flow rate that exits the opening.

For example, a 513 spray tip has a nominal fan beam width of 2 times 5=10 inches at a foot away from the surface and has a 0.013 inch size opening. A 515 spray tip has the same fan beam width as a 513; however, a 515 has a larger opening and therefore the paint flow rate will be higher. A 619 spray tip has a nominal 12 inch fan beam width when spraying 12 inches from the surface and a nozzle opening of 0.019 inches. The painter selects a spray tip that is appropriate for each type of painting. A 619 spray tip may be appropriate to paint a large concrete wall; however, a 513 spray tip may be more appropriate for painting fine furniture.

With the conventional single spray tip apparatus, one approach to increasing the width of the fan of paint spray is to select a spray tip with a larger fan beam; however, in general spray tips all have approximately a one foot wide spray beam. Also, a spray tip with a larger fan beam, such as a 619 spray tip versus a 513 spray tip, may not be appropriate because the spray tip with the larger fan beam may have a flow rate that is too large. A larger size opening in a spray tip increases the paint flow rate; however, the painter does not have as much control with a larger opening as with a smaller opening.

Another approach to cover a larger area with the conventional apparatus is for the painter to hold the spray gun further away from the surface being painted. For example, if a 513 spray tip is held about 3 feet away from the surface, then one would expect that the fan beam would triple to about 30 inches in width; however, the disadvantage of increasing the spray width by holding the spray gun further away from the surface is that more of the paint atomizes and dries in the air and therefore does not reach the surface to be painted, thereby reducing the volume of paint on the surface. This wastes paint and actually slows down the painter, because to obtain the proper volume of paint on the entire surface, the painter will have to move the spray gun slower. Therefore, moving back from the surface is not a solution to increasing the fan beam width and thereby the productivity of the painter.

Another approach to cover a larger area with the conventional apparatus is to use a dual spray nozzle, which is a device that has two spray nozzles immediately adjacent to the spray gun. In one device the nozzles can swivel 90 degrees from center. For example, the two spray nozzles can be swiveled to 30 degrees off center, which would cover a larger area than a single nozzle. However, the shortcoming with this design is that there is too much paint sprayed near the center of the larger spray fan beam and not enough paint sprayed at the two ends of the spray fan beam. Also, the painter would have less control of the painting due to the unevenness of the spray fan beam.

The conventional spray gun, while an improvement over paint brushes and paint rollers, still limits the productivity of painters.

Accordingly, there is a need in the art for a paint spray system and approach that reduces the cost of spray painting with an airless spray system and increases productivity, while maintaining an even spray fan beam.

SUMMARY OF THE INVENTION

The need in the art is addressed by a spray apparatus including an airless spray system, a spray gun having an on and off control, and a center spray device coupled to the spray gun for providing a spray, the improvement which includes a center valve device coupled to the center spray device for turning the center spray device on and off, a first extension device coupled to the spray gun for providing an extension from the spray gun, a first spray device for providing a spray attached to the first extension device, a first device for directing pressurized liquid from the spray gun to the first spray device coupled to the first spray device, and a first valve device for turning the first spray device on and off coupled to the first spray device.

In a specific embodiment the improvement further includes a first swivel device for swiveling the first spray device relative to the first extension device coupled to the first spray device, a first adjustment device for adjusting distance between the first spray device and the spray gun coupled to the first extension device and the first spray device, a first rotation device coupled to the first extension device and to the spray gun for angularly positioning the first extension device relative to the spray gun, and a first retaining device for retaining the first extension device in a plurality of angular positions relative to the spray gun coupled to the first extension device and to the spray gun.

In an alternate specific embodiment the improvement includes a second extension device coupled to the spray gun for providing an extension from the spray gun, a second spray device for providing a spray attached to the second extension device, a second device for directing pressurized liquid from the spray gun to the second spray device coupled to the second spray device, and a second valve device for turning the second spray device on and off coupled to the second spray device.

In another alternate specific embodiment for a spray apparatus including an airless spray system and a spray gun having an on and off control, the improvement includes a first extension coupled to the spray gun for providing an extension from the spray gun, a first spray device for providing a spray attached to the first extension device, a first flexible hose for directing pressurized liquid from the spray gun to the first spray device coupled to the first spray device and to the spray gun, a second extension device coupled to the spray gun for providing an extension from the spray gun, a second spray device for providing a spray attached to the second extension device, and a second flexible hose for directing pressurized liquid from the spray gun to the second spray device coupled to the second spray device and to the spray gun.

The improved airless spray system reduces the cost of spray painting with an airless spray system and increases productivity, while maintaining an even spray fan beam.

BRIEF DESCRIPTION OF THE DRAWINGS

FIG. 1 is an illustrative diagram of an improved spray apparatus for an airless spray system in accordance with the present invention.

FIG. 2 is an illustrative top view of an improved spray apparatus for an airless spray system in an extended position in accordance with the present invention.

FIG. 3 is an illustrative front elevation view of an improved spray apparatus for an airless spray system in an extended position in accordance with the present invention.

FIG. 4 is an illustrative rear elevation view of an improved spray apparatus for an airless spray system in an extended position in accordance with the present invention.

DESCRIPTION OF THE INVENTION

Illustrative embodiments and exemplary applications will now be described with reference to the accompanying drawings.

Figure 9:
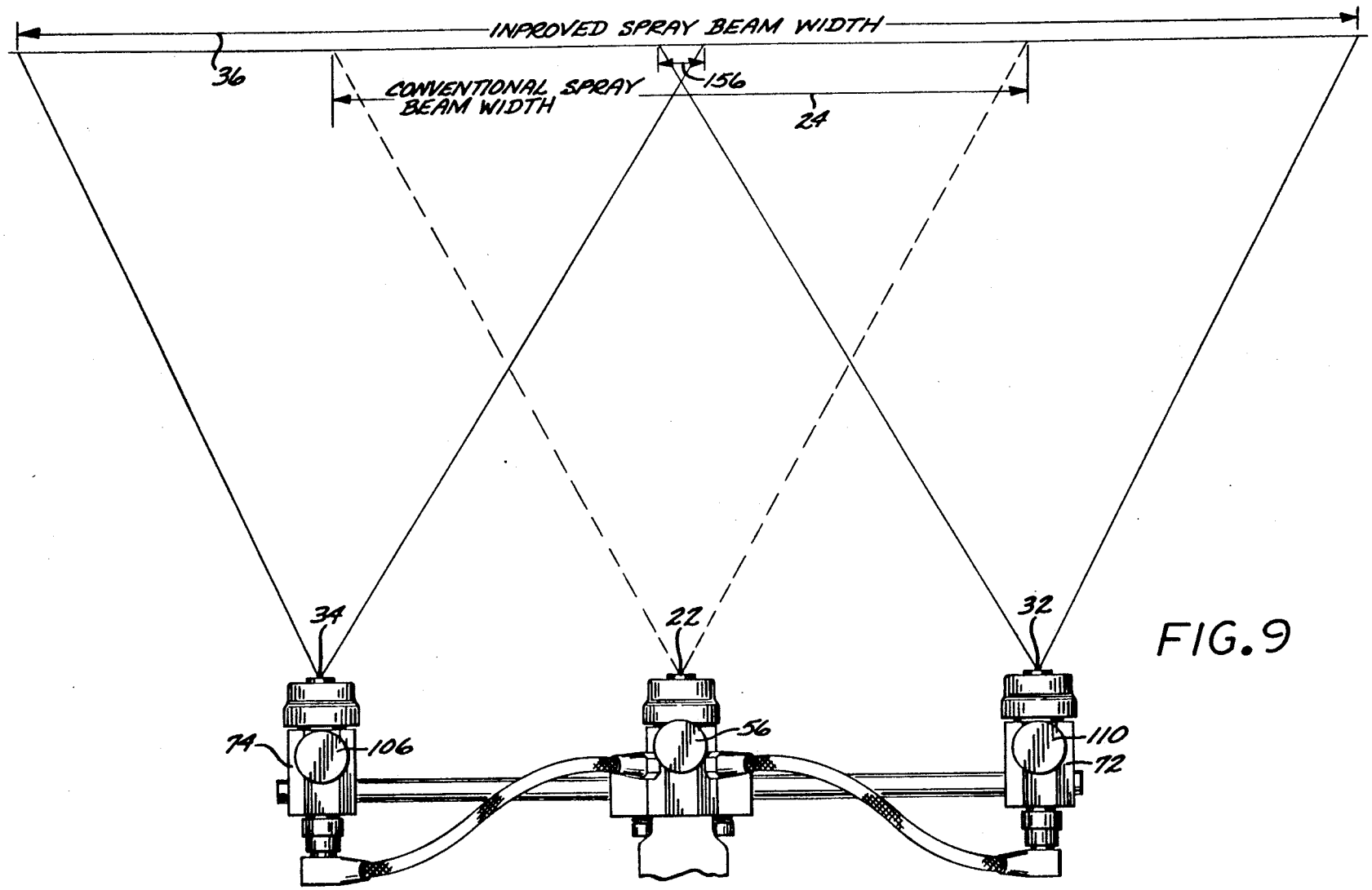
FIG. 9 is a diagram showing a conventional spray beam width and an improved spray beam width in accordance with the present invention.

FIG. 1 shows an improved airless spray system 10, which has according to conventional practice a bucket 12 for holding paint, a pump 14 for pumping the paint through a high pressure hose 16, and a spray gun 18 attached to the high pressure hose 16. In the conventional art the spray gun 18 has only a center spray tip 22 through which paint is sprayed. The painter controls the flow of paint through center spray tip 22 with spray gun trigger 20. With the one center spray tip 22, the conventional spray beam width 24 is as shown in FIG. 9.

In this invention an improved spray apparatus 30 is included, which has in addition to center spray tip 22, first spray tip 32 and second spray tip 34. By using these three spray sources properly an improved spray beam width 36 is attained which reduces the cost of spray painting and increases productivity.

FIG. 2 is an illustrative top view of an improved spray apparatus for an airless spray system in an extended position in accordance with the present invention. Center spray tip 22 is supported by center valve body 40, which is attached to spray gun 18. Extending from center valve body 40 are rods 70 and attached to the rods are valve body 72 and valve body 74 that support first spray tip 32 and second spray tip 34, respectively. Paint is transported from center valve body 40 via flexible hose 56 and flexible hose 78 to first spray tip 32 and second spray tip 34, respectively, through couplings 80 that attach to valve body 72 and valve body 74.

There is a valve to turn on or off the flow of paint to each of the spray tips. The center spray tip 22 is controlled by valve 56, the first spray tip 32 is controlled by valve 110 and the second spray tip 34 is controlled by valve 106. Generally, when painting a large surface, valve 56 is turned off, and first spray tip 32 and second spray tip 34 are turned on, which results in improved spray beam width 36, as shown in FIG. 9. When painting in close quarters or when more control of the spray beam is desired, then first spray tip 32 and second spray tip 34 are turned off and valve 56 is turned on, which results in the conventional spray beam width 24, as shown in FIG. 9. As discussed above, the spray beam width is the width of the spray beam when the spray tip is one foot away from the surface being painted.

FIG. 3 is an illustrative front elevation view and FIG. 4 is an illustrative rear elevation view of the improved spray apparatus 30 in an extended position in accordance with the present invention. As shown in FIG. 4, flexible hose 76 and flexible hose 78 can interface directly to valve body 72 and valve body 74, rather than through a coupling such as couplings 80, shown in FIG. 2.

Figure 7:
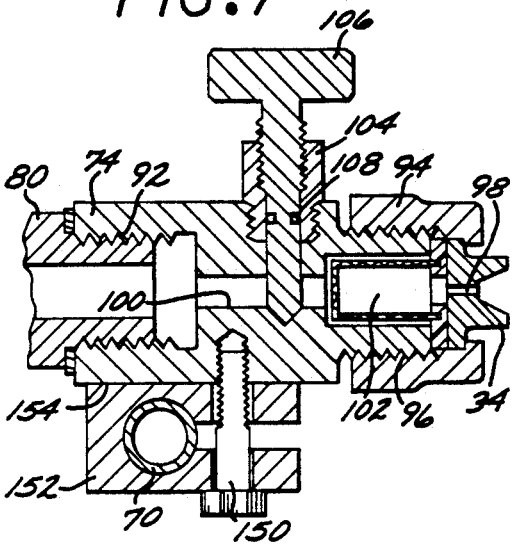
FIG. 7 is an illustrative section along line 7—7 of FIG. 2.

FIG. 7 is an illustrative section along line 7—7 of FIG. 2 showing the details of the elements attached to valve body 74. As shown, coupling 80 is threaded into valve body 74 at threads 92. The paint flows through passage 100, but can be blocked or let through by valve 106, which is threaded into valve housing 104 that is threaded into valve body 74. Leaks from valve 106 are prevented by 0-ring seal 108. If valve 106 is in an open or on position then the paint proceeds through passage 100 to filter 102, which filters the paint before it passes through nozzle 98 in second spray tip 34. The filter 102 and second spray tip 34 are held onto valve body 74 by cowling 94, which is threaded onto threads 96. The design of valve body 72 and its elements is the same as described here for valve body 74.

The valve body 74 can swivel relative to rods 70 in two directions. As shown in FIG. 7, swivel bolt 150 attaches clamp 152 to rod 70. If the swivel bolt 150 is loosened, then clamp 152 may be rotated around rod 70, which is useful for adjusting the vertical angle of the center of the spray beam. Also the valve body 74 can rotate or swivel on clamp 152 along interface 154 around swivel bolt 150. This is useful to widen or narrow the improved spray beam width 36. As spray tips wear, the spray beam from each spray tip narrows and the overlap 156 from first spray tip 32 and second spray tip 34 will diminish. The painter can compensate for this by swiveling valve body 72 and valve body 74 towards each other to maintain the overlap to ensure proper paint coverage. Also for some spray tips with a wide spray beam, the painter can swivel valve body 72 and valve body 74 away from each other to obtain the widest possible coverage. The painter can also move clamp 152 closer to spray gun 18 or further away from spray gun 18 along rod 70 by just loosening swivel bolt 150 and sliding clamp 152 to the desired position and tightening swivel bolt 150 as required to adjust the spray beam widths.

Figure 8:
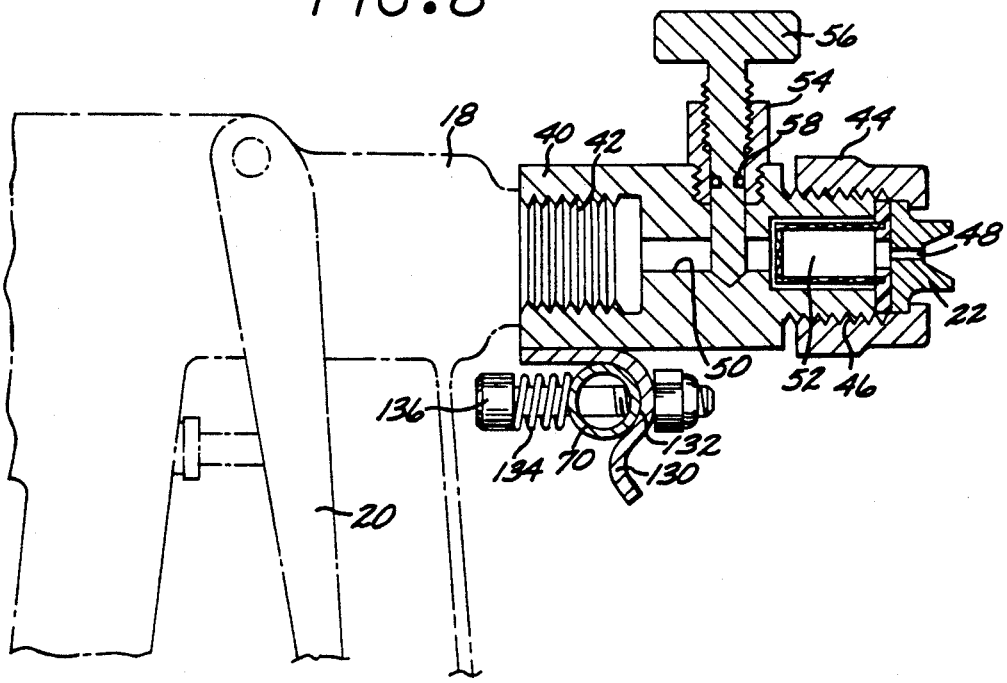
FIG. 8 is an illustrative section along line 8—8 of FIG. 2.

FIG. 8 is an illustrative section along line 8—8 of FIG. 2 showing the details of the elements attached to center valve body 40. As shown, spray gun 18 is threaded into center valve body 40 at threads 42. The paint flows through passage 50, but can be blocked or let through by valve 56, which is threaded into valve housing 54 that is threaded into center valve body 40. Leaks from valve 56 are prevented by 0-ring seal 58. If valve 56 is in an open or on position then the paint proceeds through passage 50 to filter 52, which filters the paint before it passes through nozzle 48 in center spray tip 22. The filter 52 and center spray tip 22 are held onto center valve body 40 by cowling 44, which is threaded onto threads 46.

Figure 5:
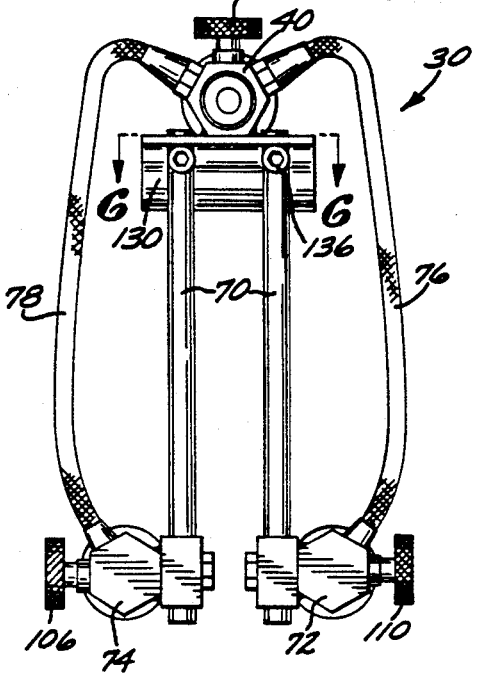
FIG. 5 is an illustrative rear elevation view of an improved spray apparatus for an airless spray system in a retracted position in accordance with the present invention.

FIG. 5 is an illustrative rear elevation view of the improved spray apparatus 30 in a retracted position in accordance with the present invention. The retracted position is useful when spraying with only center spray tip 22 with first spray tip 32 and second spray tip 34 turned off. By folding rods 70 down, valve body 72 and valve body 74 are folded close to spray gun 18 that is attached to center valve body 40, as shown in FIG. 2. This allows the painter to get the spray gun 18 into close quarters without having the extended valve body 72 and valve body 74 in the way. Also, there are situations that require just the conventional spray beam width provided by the center tip. The retracted position provides this capability. The painter turns only the center spray tip 22 on, and turns the extended spray tips off.

Figure 6:
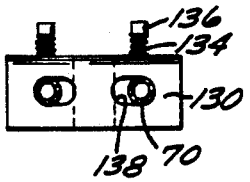
FIG. 6 is an illustrative top view of a portion of FIG. 5.

The invention has mechanisms for retaining rods 70 in either an extended or retracted positions. As shown in FIGS. 2, 3, and 4, rods 70 are attached to latch body 130 with nut and bolt 136. FIG. 8 shows a cross section of latch body 130. When the rods 70 are in an extended position, as shown in FIG. 2, the rods 70 are held within locking groove 132 of latch body 130 by spring 134, which is attached to latch body 130 by nut and bolt 136. When the rods 70 are in a retracted position, as shown in FIG. 5, the rods 70 are held in the down position by locking groove 140 shown in FIG. 4. Again, it is the spring action of spring 134 that retains the rods 70 in locking groove 140. FIG. 6 is an illustrative top view of a portion of FIG. 5, showing that the rods 70 extend through cutout 138, when the rods 70 are in the down or retracted position. The painter just snaps the rods 70 into the extended or retracted position, as desired.

In a specific embodiment the invention has two extended spray tips 32 and 32 on the end of two rods 70, in the same manner, as shown in FIG. 2; however, no center spray tip 22 is provided. The spray gun provides paint only to spray tip 32 and spray tip 34 through flexible hoses 78. In this embodiment there are no valves, such as valves 56, 106, and 110. The painter would attach this embodiment to the spray gun when a wider spray beam is needed and remove it and install conventional spray tip 22 onto the spray gun 18 when a narrower spray beam is needed. The design of the extended spray devices can be the same as shown in FIG. 7 except that elements 104, 106, and 108 are not used.

The improved airless spray system reduces the cost of spray painting with an airless spray system and increases productivity, while maintaining an even spray fan beam. Thus, the present invention has been described herein with reference to a particular embodiment for a particular application. Nonetheless, those having ordinary skill in the art and access to present teachings will recognize additional modifications, applications, and embodiments within the scope thereof. For example, the latch body of the present invention may be replaced by other equivalent devices without departing from the scope of the present invention.

It is therefore intended by the appended claims to cover any and all such applications, modifications and embodiments within the scope of the present invention.

Accordingly, what is claimed is:

1. In a spray apparatus including an airless spray system, a spray gun having an on and off control, and center spray means coupled to said spray gun for providing a spray, the improvement which comprises:

center valve means coupled to said center spray means for turning said center spray means on and off;

first extension means coupled to said spray gun for providing an extension from said spray gun;

first spray means for providing a spray attached to said first extension means;

first means for directing pressurized liquid from said spray gun to said first spray means coupled to said first spray means;

first valve means for turning said first spray means on and off coupled to said first spray means;

first swivel means for swiveling said first spray means relative to said first extension means coupled to said first spray means;

first adjustment means for adjusting distance between said first spray means and said spray gun coupled to said first extension means and said first spray means;

first rotation means coupled to said first extension means and to said spray gun for angularly positioning said first extension means relative to said spray gun; and first retaining means for retaining said first extension means in a plurality of angular positions relative to said spray gun coupled to said first extension means and to said spray gun.

2. The improvement of claim 1 which further comprises:

second extension means coupled to said spray gun for providing an extension from said spray gun;

second spray means for providing a spray attached to said second extension means;

second means for directing pressurized liquid from said spray gun to said second spray means coupled to said second spray means; and second valve means for turning said second spray means on and off coupled to said second spray means.

3. The improvement of claim 2 which further comprises:

second swivel means for swiveling said second spray means relative to said second extension means coupled to said second spray means;

second adjustment means for adjusting distance between said second spray means and said spray gun coupled to said second extension means and said second spray means;

second rotation means coupled to said second extension means and to said spray gun for angularly positioning said second extension means relative to said spray gun; and second retaining means for retaining said second extension means in a plurality of angular positions relative to said spray gun coupled to said second extension means and to said spray gun.

4. The improvement of claim 3 wherein:

said first means for directing pressurized liquid from said spray gun comprises a flexible hose; and said second means for directing pressurized liquid from said spray gun comprises a flexible hose.

5. The improvement of claim 4 wherein:

said first swivel means comprises means for rotating said first spray means around said first extension means and means for swiveling said first spray means in a plane parallel to said first extension means; and said second swivel means comprises means for rotating said second spray means around said second extension means and means for swiveling said second spray means in a plane parallel to said second extension means.

6. The improvement of claim 5 wherein:

said first retaining means for retaining said first extension means in a plurality of angular positions relative to said spray gun comprises means for retaining said first extension means in a first position away from said spray gun and means for retaining said first extension means in a second position close to said spray gun; and said second retaining means for retaining said second extension means in a plurality of angular positions relative to said spray gun comprises means for retaining said second extension means in a third position away from said spray gun and means for retaining said second extension means in a fourth position close to said spray gun.

7. The improvement of claim 6 wherein:

said first adjustment means for adjusting distance between said first spray means and said spray gun comprises a clamp coupled to said first extension means and said first spray means; and said second adjustment means for adjusting distance between said second spray means and said spray gun comprises a clamp coupled to said second extension means and said second spray means.

8. The improvement of claim 7 wherein:

said first rotation means comprises a pivot coupled to said spray gun; and said second rotation means comprises a pivot coupled to said spray gun.

9. The improvement of claim 8 wherein:

said first spray means comprises a cowling and a paint tip filter retained by said cowling and a spray tip mounted on said cowling; and said second spray means comprises a cowling and a paint tip filter retained by said cowling and a spray tip mounted on said cowling.

10. The improvement of claim 9 wherein:

said first extension means comprises a rod; and said second extension means comprises a rod.

11. The improvement of claim 10 wherein:

said center valve means comprises a valve;

said first valve means comprises a valve; and said second valve means comprises a valve.

12. In a spray apparatus including an airless spray system and a spray gun having an on and off control, the improvement which comprises:

first extension means coupled to said spray gun for providing an extension from said spray gun;

first spray means for providing a spray attached to said first extension means;

a first flexible hose for directing pressurized liquid from said spray gun to said first spray means coupled to said first spray means and to said spray gun;

second extension means coupled to said spray gun for providing an extension from said spray gun;

second spray means for providing a spray attached to said second extension means;

a second flexible hose for directing pressurized liquid from said spray gun to said second spray means coupled to said second spray means and to said spray gun;

first swivel means for swiveling said first spray means relative to said first extension means coupled to said first spray means;

first adjustment means for adjusting distance between said first spray means and said spray gun coupled to said first extension means and said first spray means;

second swivel means for swiveling said second spray means relative to said second extension means coupled to said second spray means; and second adjustment means for adjusting distance between said second spray means and said spray gun coupled to said second extension means and said second spray means.

* * * * *